US011864637B2

(12) United States Patent
Ng

(10) Patent No.: US 11,864,637 B2
(45) **Date of Patent: *Jan. 9, 2024**

(54) BRUNNIAN LINK MAKING DEVICE AND KIT

(71) Applicant: Choon's Design LLC, Farmington Hills, MI (US)

(72) Inventor: Cheong Choon Ng, Novi, MI (US)

(73) Assignee: Choon's Design LLC, Farmington Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,670

(22) Filed: May 23, 2022

(65) Prior Publication Data

US 2023/0083369 A1 Mar. 16, 2023

Related U.S. Application Data

(63) Continuation of application No. 17/038,762, filed on Sep. 30, 2020, now Pat. No. 11,337,497, which is a (Continued)

(51) Int. Cl.
*A44C 27/00* (2006.01)
*A44C 5/00* (2006.01)

(Continued)

(52) U.S. Cl.
CPC ..... *A44C 27/00* (2013.01); *A44C 5/0069* (2013.01); *B65H 69/04* (2013.01); *D04D 7/02* (2013.01); *D04D 7/04* (2013.01); *D04D 11/00* (2013.01)

(58) Field of Classification Search
CPC ..... A44C 27/00; A44C 5/0069; D04D 7/02; D04D 7/04; D04D 11/00; B65H 69/04
See application file for complete search history.

(56) References Cited

U.S. PATENT DOCUMENTS 38,192 A 4/1863 Wilcox
86,119 A 1/1869 Allport (Continued)

FOREIGN PATENT DOCUMENTS

CH 201594 11/1937
CN 101736519 A 6/2010

(Continued)

OTHER PUBLICATIONS

European Search Report for EP Application No. 14177709.4 dated Nov. 18, 2014.

(Continued)

*Primary Examiner* — Shaun R Hurley
(74) *Attorney, Agent, or Firm* — Carlson, Gaskey & Olds, P.C.

(57) ABSTRACT

A Brunnian link is a link formed from a closed loop doubled over itself to capture another closed loop to form a chain. The example kit provides for the successful creation of unique wearable articles using Brunnian link assembly techniques and includes several pin bars that are supported in a desired special orientation by at least one base. The desired special orientation is dependent on the desired linked configuration of the completed article. The pins may be assembled in various combination and orientations to provide endless variation of completed link orientations.

7 Claims, 10 Drawing Sheets

Related U.S. Application Data continuation of application No. 15/849,898, filed on Dec. 21, 2017, now Pat. No. 10,791,807, which is a continuation of application No. 14/562,990, filed on Dec. 8, 2014, now Pat. No. 9,848,679, which is a continuation of application No. 14/329,099, filed on Jul. 11, 2014, now Pat. No. 8,936,283, which is a continuation of application No. 13/938,717, filed on Jul. 10, 2013, now Pat. No. 8,955,888, which is a continuation of application No. 13/227,638, filed on Sep. 8, 2011, now Pat. No. 8,485,565.

(60) Provisional application No. 61/410,399, filed on Nov. 5, 2010.

(51) Int. Cl.

| | |
|---|---|
| ***D04D 7/02*** | (2006.01) |
| ***D04D 7/04*** | (2006.01) |
| ***D04D 11/00*** | (2006.01) |
| ***B65H 69/04*** | (2006.01) |

(56) References Cited

U.S. PATENT DOCUMENTS

| | | | | |
|---|---|---|---|---|
| 222,937 | A | | 12/1879 | Newcomb |
| 246,648 | A | | 9/1881 | Wilcox |
| 254,258 | A | | 2/1882 | Barbour |
| 254,288 | A | | 2/1882 | Dimmick |
| 266,958 | A | | 10/1882 | Gordon |
| 289,578 | A | | 12/1883 | Stewart |
| 426,087 | A | | 4/1890 | Wolkow |
| 763,303 | A | | 6/1904 | Mayers |
| 782,657 | A | | 2/1905 | Hubert |
| 843,495 | A | | 2/1907 | Sander |
| 904,747 | A | | 11/1908 | Anderson |
| 968,199 | A | | 8/1910 | Schwartz |
| 1,020,963 | A | | 3/1912 | Cake |
| 1,073,226 | A | | 9/1913 | Freeman |
| 1,176,482 | A | | 3/1916 | Orme |
| D51,186 | S | | 8/1917 | Pearson |
| 1,279,411 | A | | 9/1918 | Neuman |
| 1,318,465 | A | | 10/1919 | Seifarth |
| 1,318,604 | A | | 10/1919 | Schneider |
| 1,366,212 | A | | 1/1921 | Pollard |
| 1,375,119 | A | | 4/1921 | Stephen |
| 1,405,744 | A | | 2/1922 | Sampliner |
| 1,424,458 | A | | 8/1922 | Fleisher |
| 1,500,383 | A | | 7/1924 | Gourie |
| 1,599,040 | A | | 9/1926 | Clisby |
| 1,647,060 | A | | 10/1927 | Speidel |
| 1,694,849 | A | | 12/1928 | Fujii |
| 1,705,860 | A | | 3/1929 | Hagihara |
| 1,718,140 | A | | 6/1929 | Hagihara |
| 1,776,561 | A | | 9/1930 | La Croix |
| 1,878,861 | A | | 9/1932 | Krasnow |
| 1,994,659 | A | | 3/1935 | De A Mascarenhas |
| 2,000,504 | A | | 5/1935 | Adrian |
| 2,072,668 | A | | 3/1937 | Eltgroth |
| 2,108,424 | A | | 2/1938 | Bakely |
| 2,134,066 | A | | 10/1938 | Van Ness |
| 2,186,692 | A | | 1/1940 | Boyer et al. |
| 2,237,733 | A | | 4/1941 | Grimm et al. |
| 2,270,619 | A | | 1/1942 | Bowyer |
| 2,274,572 | A | | 2/1942 | Yates |
| 2,318,018 | A | | 5/1943 | Semonsen |
| 2,360,416 | A | | 10/1944 | Gray |
| D144,079 | S | | 3/1946 | Smith |
| D146,830 | S | | 5/1947 | Kimmelstiel |
| 2,433,307 | A | | 12/1947 | Thomas |
| 2,450,067 | A | | 9/1948 | Wolff |
| 2,457,064 | A | | 12/1948 | Parisi |
| 2,540,383 | A | | 2/1951 | Tillert et al. |
| 2,545,409 | A | | 3/1951 | McCall |
| 2,600,091 | A | | 6/1952 | Becker |
| D167,727 | S | | 9/1952 | Teare |
| 2,625,345 | A | * | 1/1953 | De Palma ..... D05B 43/00 242/139 |
| 2,658,364 | A | | 11/1953 | Carlson |
| 2,666,249 | A | | 1/1954 | Ruiz et al. |
| 2,687,630 | A | | 8/1954 | Carlson |
| 2,703,482 | A | | 3/1955 | Auran |
| 2,707,052 | A | | 4/1955 | Brown |
| 2,726,434 | A | | 12/1955 | Knoblock et al. |
| 2,727,663 | A | * | 12/1955 | Gribben ..... D05B 91/14 D3/25 |
| 2,879,095 | A | | 3/1959 | Altenweger |
| 2,984,488 | A | | 5/1961 | Kirchner |
| 3,054,214 | A | | 9/1962 | Smith et al. |
| 3,069,739 | A | | 12/1962 | Jorgenson et al. |
| 3,112,491 | A | | 12/1963 | Cleveland |
| D204,442 | S | | 4/1966 | Brawley, Jr. |
| 3,276,181 | A | | 10/1966 | Gilbert |
| 3,377,674 | A | | 4/1968 | Brassaw et al. |
| 3,438,098 | A | | 4/1969 | Grabner |
| 3,438,223 | A | | 4/1969 | Linstead |
| 3,476,423 | A | | 11/1969 | Kentfield |
| 3,476,426 | A | | 11/1969 | Lewin |
| 3,506,215 | A | * | 4/1970 | Krikorian ..... D05B 91/14 223/106 |
| 3,572,679 | A | | 3/1971 | Strauff |
| 3,636,987 | A | | 1/1972 | Forby |
| 3,648,484 | A | | 3/1972 | Gordon |
| 3,665,971 | A | | 5/1972 | Ileks |
| 3,672,679 | A | | 6/1972 | Burns |
| 3,678,709 | A | | 7/1972 | Nowicki et al. |
| 3,688,357 | A | | 9/1972 | Nielsen et al. |
| 3,693,976 | A | | 9/1972 | Flack |
| 3,728,762 | A | | 4/1973 | Hogg |
| 3,748,706 | A | | 7/1973 | Doyel |
| 3,758,923 | A | | 9/1973 | Maude |
| 3,800,372 | A | | 4/1974 | Daoust |
| 3,805,345 | A | | 4/1974 | Antos |
| 3,853,021 | A | | 12/1974 | Hayes |
| 3,905,133 | A | | 9/1975 | Charman |
| D238,812 | S | | 2/1976 | Fioretti |
| 4,018,543 | A | | 4/1977 | Carson et al. |
| 4,023,245 | A | | 5/1977 | Zaltzman |
| 4,032,179 | A | | 6/1977 | Goss |
| 4,037,513 | A | | 7/1977 | Hobson |
| D245,748 | S | | 9/1977 | Ostroll |
| 4,066,271 | A | | 1/1978 | Lohr |
| D248,347 | S | | 7/1978 | McCollum |
| 4,114,892 | A | | 9/1978 | Csoka |
| 4,131,138 | A | | 12/1978 | Boisvert |
| 4,179,129 | A | | 12/1979 | Loomis |
| D257,257 | S | | 10/1980 | McArthur |
| 4,248,063 | A | | 2/1981 | Wang |
| 4,416,040 | A | | 11/1983 | Towsley |
| D279,938 | S | | 8/1985 | Okada |
| 4,569,108 | A | | 2/1986 | Schwab |
| 4,629,100 | A | | 12/1986 | Owens |
| 4,667,965 | A | | 5/1987 | Helms, Jr. |
| 4,680,021 | A | | 7/1987 | Maxim |
| 4,729,229 | A | | 3/1988 | Whicker |
| 4,790,575 | A | * | 12/1988 | Tate ..... D04G 5/00 289/17 |
| 4,844,473 | A | | 7/1989 | Landsberg |
| D310,672 | S | | 9/1990 | Harvey et al. |
| D330,668 | S | | 11/1992 | Nagamatsu |
| 5,163,946 | A | | 11/1992 | Li |
| 5,231,742 | A | | 8/1993 | Macbain |
| 5,295,280 | A | | 3/1994 | Hudson et al. |
| 5,328,374 | A | | 7/1994 | Stevens |
| 5,331,725 | A | | 7/1994 | Chou |
| 5,377,595 | A | | 1/1995 | Liu |
| 5,426,788 | A | | 6/1995 | Meltzer |
| 5,437,459 | A | | 8/1995 | Kirby |
| 5,459,905 | A | | 10/1995 | Voyre |
| 5,577,299 | A | | 11/1996 | Thompson et al. |
| 5,639,090 | A | | 6/1997 | Stevens |
| 5,687,775 | A | | 11/1997 | Thompson et al. |
| D389,050 | S | | 1/1998 | Li |
| 5,713,094 | A | | 2/1998 | Markey et al. |

(56) References Cited

U.S. PATENT DOCUMENTS

| | | | |
|---|---|---|---|
| D406,749 | S | 3/1999 | Selk |
| 5,888,392 | A | 3/1999 | Frizell |
| 5,916,283 | A | 6/1999 | Steinbach |
| 5,927,764 | A | 7/1999 | Harriman |
| D425,784 | S | 5/2000 | Beugelsdyk et al. |
| 6,065,968 | A | 5/2000 | Corliss |
| D426,425 | S | 6/2000 | Hermanski |
| 6,122,859 | A | 9/2000 | Azar |
| 6,129,551 | A | 10/2000 | Martin |
| 6,131,778 | A | 10/2000 | Etzion |
| 6,146,144 | A | 11/2000 | Fowler et al. |
| 6,149,436 | A | 11/2000 | Dunn |
| 6,171,317 | B1 | 1/2001 | Jackson et al. |
| 6,209,930 | B1 | 4/2001 | Johnston et al. |
| 6,213,918 | B1 | 4/2001 | Rogers, Jr. |
| 6,389,652 | B1 | 5/2002 | Williams |
| 6,550,177 | B1 | 4/2003 | Epple, Jr. |
| D478,738 | S | 8/2003 | Workman |
| 6,786,032 | B2 | 9/2004 | Chia et al. |
| 6,880,364 | B1 | 4/2005 | Vidolin et al. |
| 6,902,212 | B1 | 6/2005 | Mize |
| 6,923,026 | B1 | 8/2005 | Clarke |
| 7,040,120 | B2 | 5/2006 | Hunter |
| D522,352 | S | 6/2006 | Van Straaten |
| 7,240,797 | B1 | 7/2007 | Grossman |
| 7,264,282 | B2 | 9/2007 | Lambertz et al. |
| D552,463 | S | 10/2007 | French et al. |
| D562,358 | S | 2/2008 | Landmesser |
| D563,997 | S | 3/2008 | Gustin |
| D570,923 | S | 6/2008 | Vazquez Gastellu |
| D578,383 | S | 10/2008 | Adams |
| 7,506,524 | B2 | 3/2009 | Gustin |
| D592,537 | S | 5/2009 | Darnell |
| 7,578,146 | B2 | 8/2009 | Gustin |
| 7,617,947 | B2 | 11/2009 | Schafer |
| D608,189 | S | 1/2010 | Jackson et al. |
| 7,666,196 | B1 | 2/2010 | Miles |
| 7,677,677 | B1 | 3/2010 | Roberts |
| 7,891,506 | B2 | 2/2011 | Kornowski |
| 7,909,609 | B2 | 3/2011 | Molin |
| D635,594 | S | 4/2011 | Novak |
| D639,683 | S | 6/2011 | Essel |
| 8,104,486 | B2 | 1/2012 | Imai et al. |
| 8,171,639 | B2 | 5/2012 | Jaykins et al. |
| 8,234,850 | B1 | 8/2012 | Wright |
| 8,316,894 | B2 | 11/2012 | Schaub |
| 8,402,794 | B2 | 3/2013 | Sasur |
| 8,418,434 | B1 | 4/2013 | Carruth et al. |
| 8,485,565 | B2 | 7/2013 | Ng |
| 8,510,916 | B2 | 8/2013 | Kinvi |
| D690,191 | S | 9/2013 | Takakuwa et al. |
| D696,576 | S | 12/2013 | Ng |
| 8,596,096 | B1 | 12/2013 | Russell et al. |
| 8,622,441 | B1 | 1/2014 | Ng |
| 8,684,420 | B2 | 4/2014 | Ng |
| 8,746,753 | B2 | 6/2014 | Crorey |
| D711,931 | S | 8/2014 | Daftari |
| 8,899,631 | B2 | 12/2014 | Ng |
| 8,931,811 | B1 | 1/2015 | Ng |
| 8,973,955 | B2 | 3/2015 | Ng |
| 9,234,306 | B1 | 1/2016 | Chang |
| 9,273,803 | B2 | 3/2016 | Adams |
| 9,750,315 | B2 | 9/2017 | Ng |
| 9,848,679 | B2 | 12/2017 | Ng |
| 10,791,807 | B2 * | 10/2020 | Ng ..... D04D 7/02 |
| 2004/0079109 | A1 | 4/2004 | Crova |
| 2007/0114340 | A1 | 5/2007 | Adams |
| 2007/0199965 | A1 | 8/2007 | Gouldson |
| 2008/0156043 | A1 | 7/2008 | Gustin |
| 2008/0223083 | A1 | 9/2008 | Gustin |
| 2009/0215013 | A1 | 8/2009 | Molin |
| 2009/0272148 | A1 | 11/2009 | Jaykins |
| 2010/0019495 | A1 | 1/2010 | Oliveto |
| 2010/0163069 | A1 | 7/2010 | Imai et al. |
| 2011/0067558 | A1 | 3/2011 | Saindon |
| 2011/0152946 | A1 | 6/2011 | Frigg et al. |
| 2011/0204554 | A1 | 8/2011 | Younger |
| 2011/0259465 | A1 | 10/2011 | Schaub |
| 2012/0047960 | A1 | 3/2012 | Sasur |
| 2012/0112457 | A1 | 5/2012 | Ng |
| 2012/0150203 | A1 | 6/2012 | Brady et al. |
| 2012/0186217 | A1 | 7/2012 | Wright |
| 2012/0297749 | A1 | 11/2012 | Dhongade |
| 2013/0020802 | A1 | 1/2013 | Ng |
| 2013/0300114 | A1 | 11/2013 | Ng |
| 2013/0307267 | A1 | 11/2013 | Ng |
| 2014/0373966 | A1 | 12/2014 | Nedry et al. |
| 2015/0296937 | A1 | 10/2015 | Ng |
| 2015/0345051 | A1 | 12/2015 | Wright |

FOREIGN PATENT DOCUMENTS

| | | | |
|---|---|---|---|
| DE | 521894 | | 3/1931 |
| GB | 2147918 | | 5/1985 |
| JP | S61111987 | U | 7/1986 |
| JP | H0325590 | U | 3/1991 |
| JP | H09291447 | | 11/1997 |
| JP | 2003-171854 | A | 6/2003 |
| JP | 2003-520083 | | 7/2003 |
| JP | 2004-520910 | | 7/2004 |
| JP | 3108472 | U | 4/2005 |
| JP | 3120700 | U | 4/2006 |
| JP | 4214168 | B1 | 1/2009 |
| JP | D1393632 | | 8/2010 |
| JP | 2010261130 | A | 11/2010 |
| JP | 2011117103 | A | 6/2011 |
| JP | 2012162837 | A | 8/2012 |
| JP | D1501836 | | 7/2014 |
| JP | D1501837 | | 7/2014 |
| KR | 10-2001-0012609 | | 2/2001 |
| KR | 10-2006-0042108 | | 5/2006 |
| KR | 300503642 | | 5/2008 |
| WO | 2012/060906 | A1 | 5/2012 |
| WO | 2014/190255 | A1 | 11/2014 |

OTHER PUBLICATIONS

European Search Report for EP Application No. 14184490.2 dated Dec. 23, 2014.

International Search Report and Written Opinion for International Application No. PCT/US14/54492 dated Jan. 5, 2015.

U.S. Appl. No. 14/226,096, filed Mar. 26, 2014, entitled "Monster Tail Loom For Forming Brunnian Links".

International Search Report and Written Opinion for International Application No. PCT/US2015/026280 dated Jul. 14, 2015.

Helmet Strap Quick Release Clip, catalog added date Nov. 10, 2011, online, http://allbrandsofthings.com/index.php?main_page=product_info&cPath=33&products_id=457&zenid=adrmed661oj5gqu9dlhqpqgmm7.

Amazon.com—Plastic Trash Can Bag Clip Clamp, review date Feb. 19, 2014, online, http://www.amazon.com/Plastic-Garbage-Rubbish-Trash-Holder/dp/B00E6Q0DQ0/ref=sr.

Petition for Inter Partes Review of U.S. Patent No. 8,684,420 and Exhibits, filed in the United States Patent and Trademark Office on Sep. 4, 2015, Case No. IPR2015-01883.

International Search Report & Written Opinion for International Application No. PCT/US2011/041553 dated Feb. 23, 2012.

International Preliminary Report on Patentability for International Application No. PCT/US2011/041553 dated May 16, 2013.

United Kingdom Combined Search and Examination Report for Application No. GB1416090.1 dated Oct. 16, 2014.

United Kingdom Combined Search and Examination Report for Application No. GB1416091.5 dated Oct. 16, 2014.

International Search Report and Written Opinion for International Application No. PCT/US14/46106 dated Oct. 18, 2014.

International Search Report and Written Opinion for International Application No. PCT/US14/54475 dated Oct. 27, 2014.

How to make a fishtail rainbow loom bracelet; http://www.youtube.com/watch?v=ukv83Cvq3jk; Jul. 13, 2013.

(56) References Cited

OTHER PUBLICATIONS

European Search Report for EP Application No. 13840473.6 dated Jul. 3, 2014.
Petition for Post-Grant Review of U.S. Pat. No. 8,684,420 and Exhibits, filed in the United States Patent and Trademark Office on Aug. 5, 2014, Case No. PGR2014-00008.
Petition for Inter Partes Review of U.S. Pat. No. 8,485,565 and Exhibits, filed in the United States Patent and Trademark Office on Aug. 20, 2014, Case No. IPR2014-01353.
Takacas, Sarah (SarahLynnTea), "How to Make Rubber Band Bracelets"; Published Apr. 15, 2009 http://www.youtube.com/watch?v=e0k762PJ-D8.
Introduction video—Rainbow Loom (the next generation Twistz Bandz kit). Published Sep. 24, 2012. http://www.youtube.com/watch?v=FUwf3CheGuw.
Lesson 21: "Sweet Heart" Rainbow Loom Bracelet by Choon; Published Jan. 21, 2013 http://www.youtube.com/watch?v=7l8MbYceEC0.
Rainbow Loom from Choon's Design, LLC; Published Jul. 24, 2013 http://www.youtube.com/watch?v=vhiVxnbE0CE.
How to make a rainbow loom starburst bracelet; Published Aug. 1, 2013 http://www.youtube.com/watch?v=RI7Akl5dJzo.
How To: Make the Rainbow Loom Single Band Bracelet; Published Aug. 12, 2013 http://www.youtube.com/watch?v=Wd3UdqPmKbA.
How to Make Rubber Band Bracelets Using Twistz Bandz—Instruction #1; http://www.youtube.com/watch?v=6nlnnVEjrLU; March 28, 2011.
Various rubber band crafts and bracelets using Rainbow Loom®; http://www.youtube.com/watch?v=oM6sOkZFz5o; Mar. 30, 2011
How to make "Diamond" pattern rubber band bracelet using the Rainbow Loom® Kit; http://www.youtube.com/watch?v=dZa8dpZasKA; Jun. 8, 2011.
(Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* v. *Zenacon, LLC et al.,* United States District Court for the Eastern District of Michigan, Case No. 2:13-cv-13568-PJD-RSW, Mar. 7, 2014.
Decision to Institute of Inter Partes Review of U.S. Patent No. 8,485,565 dated May 20, 2014, Case IPR2014-00218, from the United States Patent and Trademark Office.
Petitioner's Request for Rehearing Under 37 CFR §42.71(d) filed on Jun. 3, 2014, Case IPR2014-00218, from the United States Patent and Trademark Office.
Continuation U.S. Appl. No. 13/938,717, filed Jul. 10, 2013, entitled "Brunnian Link Making Device and Kit".
Continuation U.S. Appl. No. 14/329,099, filed Jul. 11, 2014, entitled "Brunnian Link Making Device and Kit".
Continuation in Part U.S. Appl. No. 13/626,057, filed Sep. 25, 2012, entitled "Brunnian Link Making Device and Kit".
U.S. Appl. No. 14/331,456, filed Jul. 15, 2014, entitled "Hand Held Link Making Device and Kit".
U.S. Appl. No. 14/270,635, filed May 6, 2014, entitled "Device for Forming Brunnian Links".
U.S. Appl. No. 29/468,891, filed Oct. 24, 2013, entitled "Brunnian Link Forming Loom".
Design U.S. Appl. No. 29/468,549, filed Oct. 1, 2013, entitled "Brunnian Link Forming Loom".
European Search Report for EP Application No. 14184498.5 dated Jan. 26, 2015.
International Preliminary Report on Patentability for International Application No. PCT/US2013/060890 dated Apr. 9, 2015.
Petition for Inter Partes Review of U.S. Pat. No. 8,622,441 and Exhibits, filed in the United States Patent and Trademark Office on Mar. 3, 2015, Case No. IPR2015-00840.
Norris, Kathy, I Can't Believe I'm Loom Knitting!, www.leisurearts.com, 2010.
Phelps, Isela, Loom Knitting Primer: A Beginner's Guide to Knitting on a Loom with Over 30 Fun Projects, 2007.
Lijovich, Basic Instructions for Using a Double Lucet, Jan. 2002, revised Jun. 2002.
The Horde of Vigdis, Aug. 5, 2011.
International Search Report and Written Opinion for International Application No. PCT/US2013/060890 dated Jan. 2, 2014.
Petition for Inter Partes Review of U.S. Pat. No. 8,485,565 and Exhibits, filed in the United States Patent and Trademark Office on Mar. 3, 2015, Case No. IPR2015-00838.
Petition for Inter Partes Review of U.S. Pat. No. 8,485,565 and Exhibits, filed in the United States Patent and Trademark Office on May 1, 2015, Case No. IPR2015-01139.
Petition for Inter Partes Review of U.S. Pat. No. 8,684,420 and Exhibits, filed in the United States Patent and Trademark Office on May 4, 2015, Case No. IPR2015-01143.
Phelps, Isela, Loom Knitting Primer: A Beginner's Guide to Knitting on a Loom with Over 30 Fun Projects, 2007, pp. 12-20, 99, and 118.
Phelps, Isela G., Loom Knitting Basics: Knitting in the Round, www.dalooms.com, 2001.
How to Make a Homemade Geoboard, http://www.feelslikehomeblog.com/2010/02/how-to-make-a-geoboard/, Feb. 21, 2010.
Bipes, Anne, Loom Knitting Getting Started on the Round Loom, www.loomknitting.com, 2005.
Takacs, Sararah (SoCraftastic), "Rainbow Loom—Single Bracelet—How To—No Loom," Published Oct. 15, 2010 https://www.youtube.com/watch?v=rwgpf0kuZDY.
Order Granting Request for Ex Parte Reexamination for U.S. Appl. No. 90/019,235 mailed Sep. 13, 2023.

* cited by examiner

BRUNNIAN LINK MAKING DEVICE AND KIT

REFERENCE TO RELATED APPLICATION

This application is a continuation of U.S. application Ser. No. 17/038,762 filed on Sep. 30, 2020, now U.S. Pat. No. 11,337,497, which is a continuation of U.S. application Ser. No. 15/849,898 filed on Dec. 21, 2017, now U.S. Pat. No. 10,791,807 granted on Oct. 6, 2020, which is a continuation of U.S. application Ser. No. 14/562,990 filed on Dec. 8, 2014, now U.S. Pat. No. 9,848,679 granted on Dec. 26, 2017, which is a continuation of U.S. application Ser. No. 14/329,099 filed on Jul. 11, 2014, now U.S. Pat. No. 8,936,283 granted on Jan. 20, 2015, which is a continuation of U.S. application Ser. No. 13/938,717 filed on Jul. 10, 2013, now U.S. Pat. No. 8,955,888 granted on Feb. 17, 2015, which is a continuation of U.S. application Ser. No. 13/227,638 filed on Sep. 8, 2011, now U.S. Pat. No. 8,485,565 granted on Jul. 16, 2013, that claims priority to U.S. Provisional Application No. 61/410,399 filed on Nov. 5, 2010.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item. Accordingly there is a need and desire for a kit that provides not only the materials for creating a unique wearable item, but also that simplifies construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example kit and device provides for creation of Brunnian link articles of complex configurations. Moreover, the example kit provides for the successful creation of unique wearable articles using Brunnian link assembly techniques.

The example kit includes several pin bars that are supported in a desired spatial orientation by at least one base. The desired spatial orientation is dependent on the desired link configuration of the completed article. The base and pin bars may be assembled in various combination and orientations to provide endless variation of completed link orientations. Moreover, additional bases and pin bars can be added to further expand possible completed article creation.

Each of the pin bars includes a flanged top portion for holding elastic bands in place and a front access groove. The front access groove provides for a hook to be inserted below a top most elastic band such that a lower band can be grasped and pulled over an adjacent band to form the Brunnian link. The disclosed kit provides for many possible orientations of adjacent pins, and therefore different orientations of and designs for a completed linked article.

These and other features disclosed herein can be best understood from the following specification and drawings, the following of which is a brief description.

DETAILED DESCRIPTION

Figure 1:
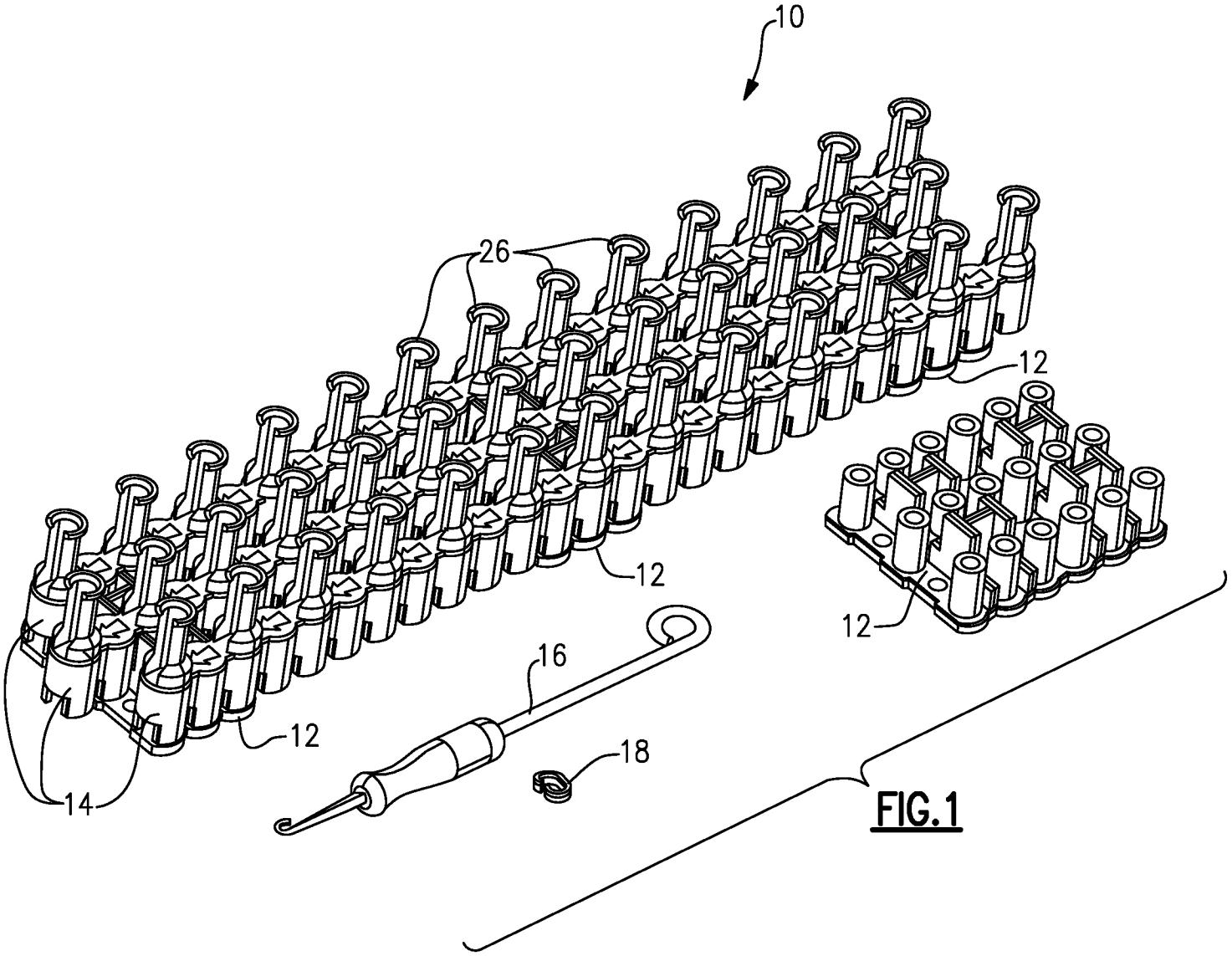
FIG. 1 is a perspective view of an example kit for creating a Brunnian link article.
Figure 2:
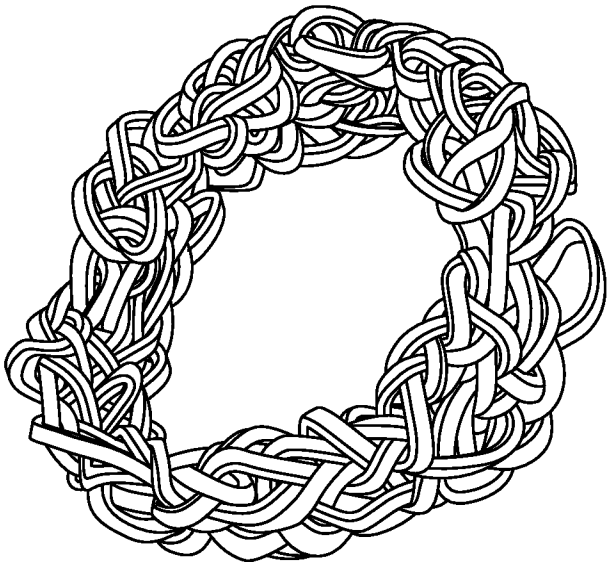
FIG. 2 is schematic view of Brunnian link articles.

Referring to FIGS. 1, an example kit is indicated at 10 for creating Brunnian link items such as bracelets, necklaces and other wearable or decorative items shown in FIG. 2.

Figure 3:
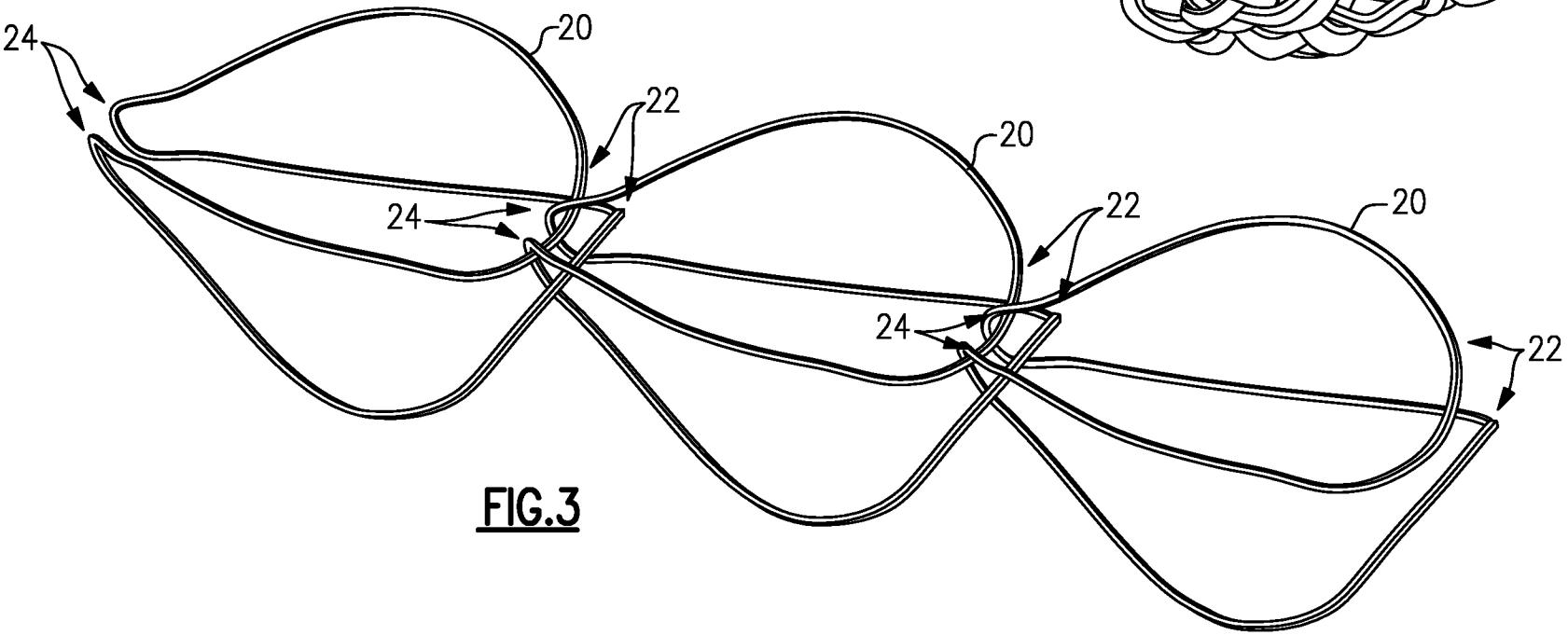
FIG. 3 is a schematic view of a series of Brunnian links.

Referring to FIG. 3, a Brunnian link 20 is formed from a continuous looped structure without forming an actual knot. Several links are formed in a chain to form a circular structure. The ends are then secured and a durable wearable item is created. In this example three closed looped elastic items 20 such as rubber bands are shown forming a single chain. Each link is formed by capturing ends 22 of one loop structure with a mid portion 24 of another loop structure in series. Each link depends on the previous and subsequent links to maintain the desired shape and integrity. Removing one link 20 results in all of the links becoming loose from each other.

Referring to FIG. 1, the example kit 10 includes a base 12 that supports pin bars 14 that each includes a plurality of pins 26. A hook tool 16 is included for grasping and moving bands from one pin 26 to another. A clip 18 receives ends of the completed links to complete and secure the linked item. One or several pin bars 14 are mounted to several bases 12 as is shown to support the pin bars 14 and the corresponding pins 26 in a desired alignment. In this example, a center pin bar 14 is incremented one up from the two outermost pin bars 14. This alignment provides for creation of a desired linked item. In this example three bases 12 are utilized to support the pin bars 14 in a desired relative orientation.

Figure 4:
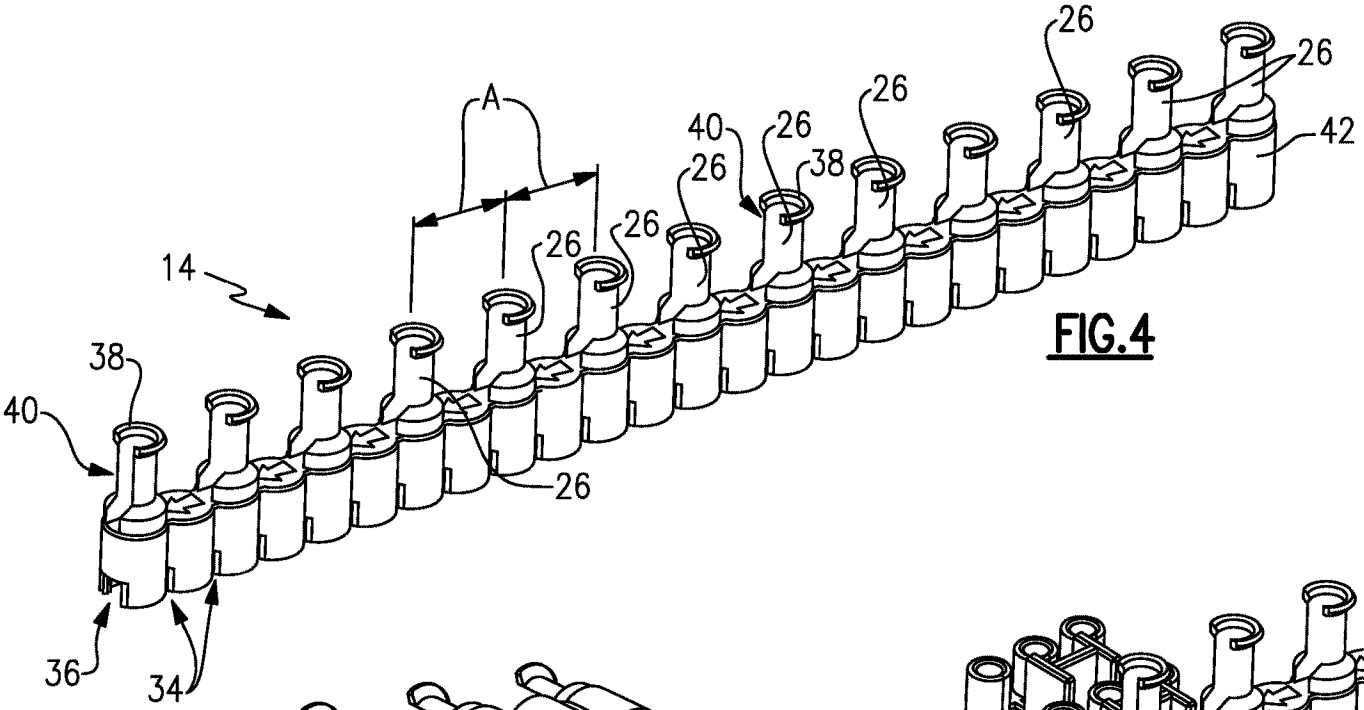
FIG. 4 is a perspective view of an example pin bar.
Figure 5B:
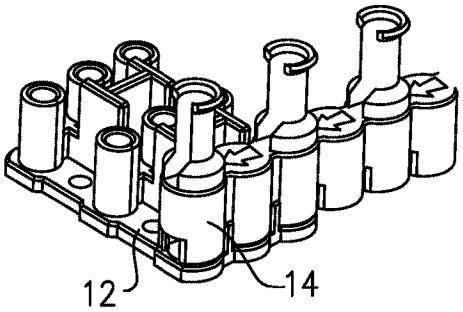
FIG. 5B is a perspective view of a pin bar mounted to an example base.
Figure 5A:
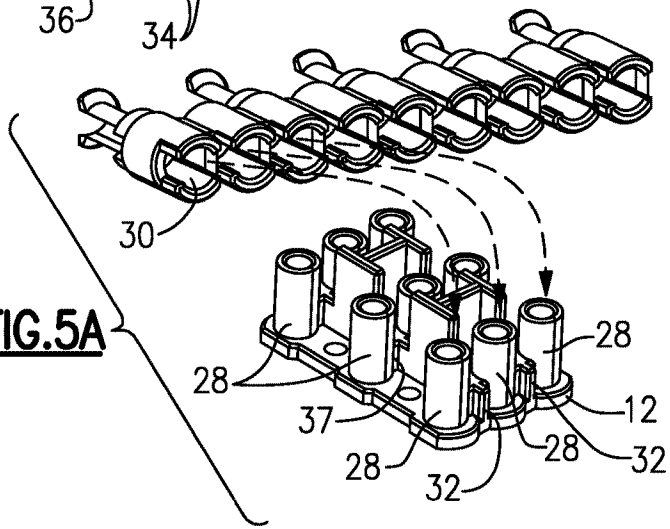
FIG. 5A is a perspective view of interfacing surfaces of an example base and the example pin bar.
Figure 9:
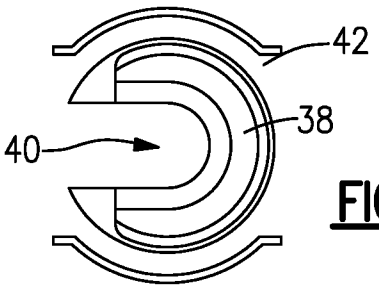
FIG. 9 is a top view of an example pin.
Figure 8:
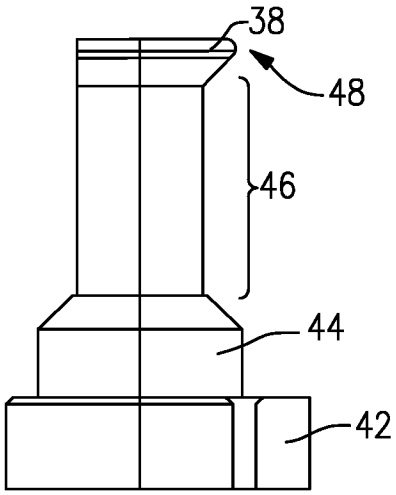
FIG. 8 is side view of an example pin.
Figure 7:
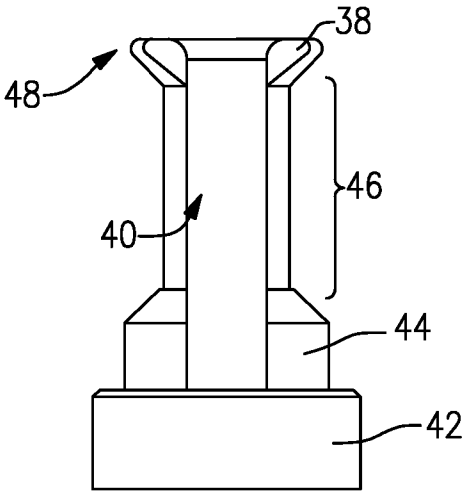
FIG. 7 is front view of one example pin.
Figure 6:
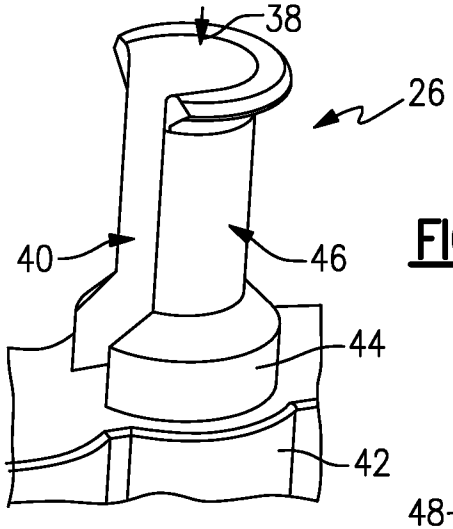
FIG. 6 is a perspective view of one pin of the example pin bar.

Referring to FIGS. 4, 5A-B, with continued reference to FIG. 1, the base 12 includes a plurality of upward extending cylinders 28 that are received within a corresponding opening 30 defined at the bottom of each pin 26 the pin bar 14. The cylinders 28 of the base 12 and the openings 30 receiving the cylinders 28 are mating features that define a slight interference fit to hold the pin bar 14 in place. Although three bases 12 are shown in this example, more or less could be utilized to support additional numbers of pin bars 14.

The base 12 includes tabs 32 disposed between the cylinders 28 that fit within corresponding slots 34 defined on the pin bar 14. The interface between the tabs 32 and slots 34 provide alignment and maintain the upright orientation of the pin bars 14. Each of the pins 26 includes a front slot 36 that receives a boss 37 defined between cylinders 28 of the base 12. The front slot 34 and boss 37 interface further aligns and supports the pin bar 14 on the base 12.

The pin bar 14 is an integral structure having the plurality of pins 26 defined in a single row. Each of the pins 26 are spaced an equal distance A apart. Each of the pins 26 includes a flanged top 38 and a front access groove 40.

Referring to FIGS. 6, 7, 8 and 9, each pin 26 extends upward from a bar portion 42 and include features for holding and spacing rubber bands. Each pin 26 includes the flanged top 38 that is flared outward to an outer edge 48 to prevent errant release of a rubber band during creation of a link. The example outer edge 48 is a rounded edge about the flanged top 38. The access groove 40 is a longitudinal groove that extends inward toward a center of the pin 26. The access groove 40 extends from the bar portion 42 to an open end with the flanged top 38. That is, groove 40 extends to a top end of the pin 26 and through the flanged top 38. The groove 40 provides a clearance for insertion of the hook tool 16 (FIG. 1) utilized for moving ends of a rubber band between pins 32.

Each of the pins 26 includes a bottom portion 44 that is flared outward from a diameter of a mid portion 46. The mid portion 46 of the pin 26 is where a rubber band is secured during assembly. The bottom portion 44 is flared outward to prevent the rubber band from slipping downward against the bar portion 42. The top flanged top 38 and the bottom portion 44 centers the rubber bands in the mid portion 46 to provide a desired alignment during assembly. The edges of the flanged top 38 are rounded over to eliminate sharp edges or surfaces.

Figure 11A:
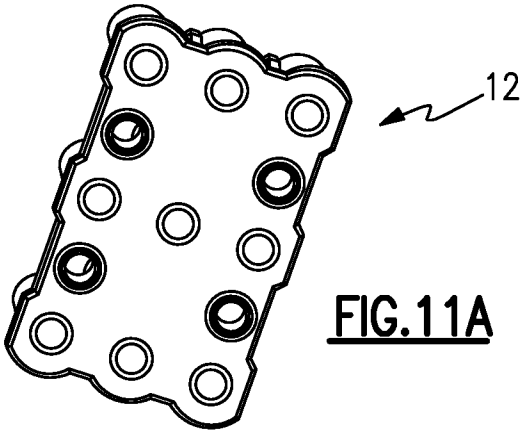
FIG. 11A is a bottom view of the example base.
Figure 10A:
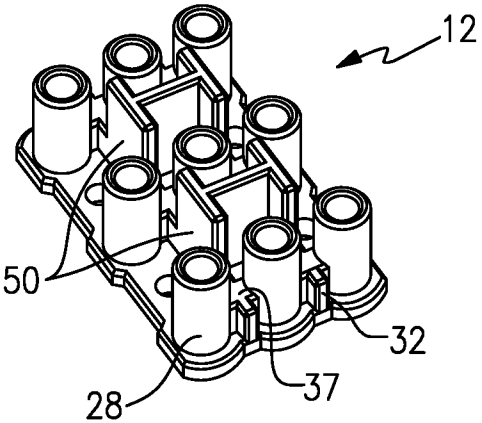
FIG. 10A is a perspective view of an example base.

Referring to FIGS. 10A and 11A, the example base 12 includes three rows of three cylinders 28 that are spaced equal distance from each other. Accordingly, the pin bars 14, and thereby the rows of pins 26 are also spaced an equal distance from each other. The tabs 32 and bosses 37 are received within corresponding slots 34 and 36 formed on the pin bar 14. A stabilizer 50 is disposed between each row of cylinders 28 to provide further lateral support for the pin bars 14.

Figure 10B:
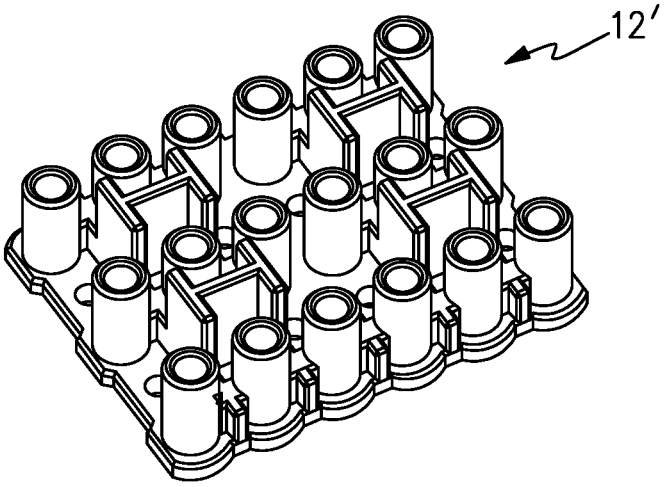
FIG. 10B is a perspective view of another example base.
Figure 11B:
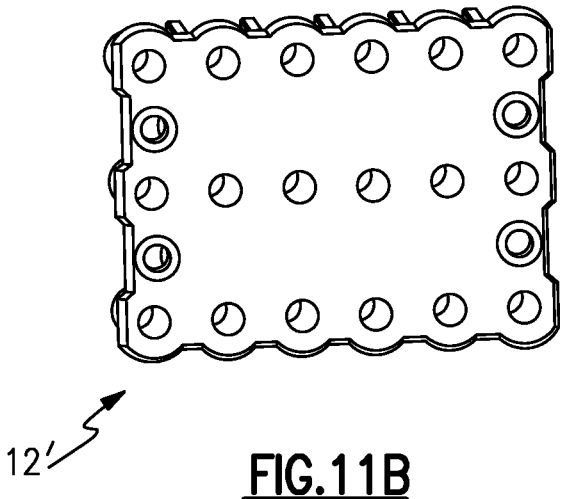
FIG. 11B is a bottom view of another example base.

Referring to FIGS. 10B and 11B, another example base 12' includes three rows of six cylinders 28 that are spaced an equal distance from each other. The additional cylinders 28 provided by the larger example base 12' provide for mounting of additional pin bars 14 with the same number of bases 12'. As appreciated, it is within the contemplation of this disclosure to provide a base with any number of rows of and columns of cylinders 28 that provide varying mounting configurations for the pin bars 14.

Figure 13:
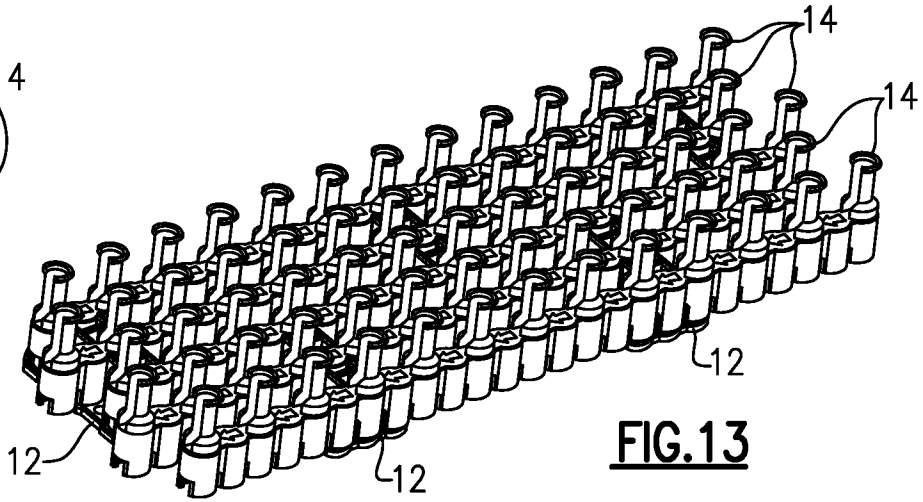
FIG. 13 is an assembly view of several pin bars mounted relative to each other in one desired special orientation.
Figure 12:
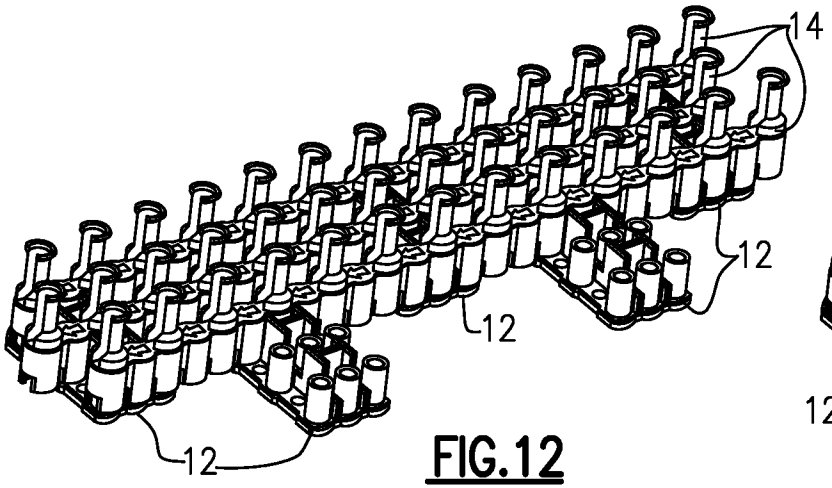
FIG. 12 is an assembly view of several bases assembled to several pin bars.

Referring to FIGS. 12 and 14, the base 12 is utilized to set a desired pattern and uniform spacing between several pin bars 14. Accordingly, each of the bases 12 can engage one or several bin bars 14. The base 12 can engage and be receive three pin bars 14 longitudinally, and/or may be added to a side of a group of pin bars to add additional pin bars beyond the three provided for by one base 12. In this configuration, the three pin bars 14 form three rows of pins 26. As can be seen in FIGS. 12 and 13, each pin 26 has its access groove 40 facing a common front, side of the assembly. FIG. 12 illustrates a configuration where three bases are supporting three pin bars 14 and two additional bases 12 are engaged to the current pin bars 14 with only one row such that two rows of cylinders 28 extend laterally to receive additional pin bars 14. FIG. 13 illustrates a configuration where five pin bars 14 are aligned side by side as provided by the additional bases 12 extending laterally as shown in FIG. 12. As is appreciated, the extent to which additional bases and pin bars 14 can be added and the configurations possible are limited only be the desire of the user of the disclosed kit. The addition of pin bars 14 provides for more unique and intricate designs limited only by the imagination of the user of the kit.

Figure 14C:
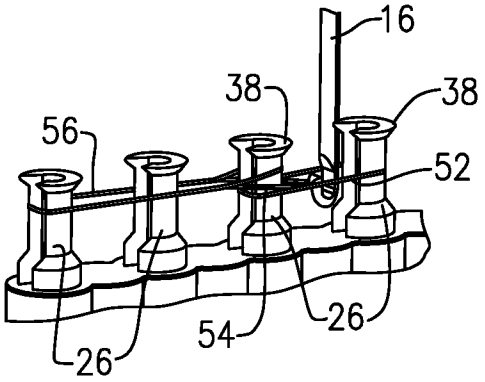
FIGS. 14A-C are perspective views of assembly steps for creating a Brunnian linked article.
Figure 14B:
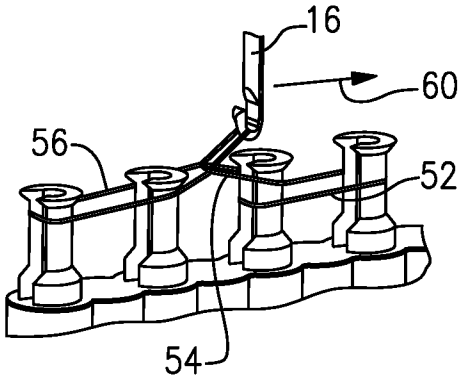
Figure 14A:
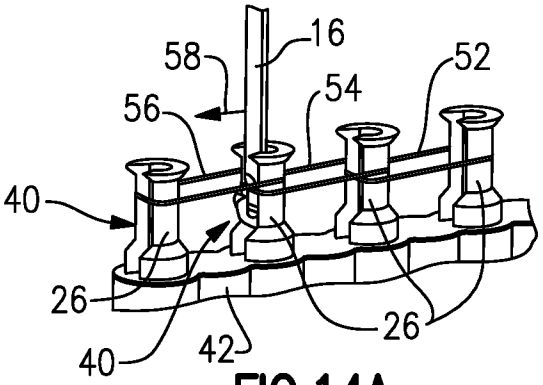

Referring to FIGS. 14A-C, a method of forming a Brunnian link as provided by the example kit includes the initial step of loading elastic bands onto adjacent pins 26. In this example, beginning at the right most ends each rubber band are stretched over adjacent pins and held at the mid portion. A first elastic band 52 is placed between a first pair of adjacent pins 26 A second elastic band 54 is then placed over one end of the previously assembled first elastic band 52, and then a third elastic band 56 and so on until the desired number of rubber bands have been placed on corresponding pin bars 14. Note that in this example only three elastic bands 52, 54, and 56 are shown for explanation purposes, however, in practice, many elastic bands would be utilized to provide the desired length of a completed article.

Once the elastic bands 52, 54, and 56 are placed on each of the pins 26, the hook 16 is inserted into the access groove 40 and moved downward past the top most elastic bands 56. The hook 16 is then moved outward from the groove in a direction indicated by arrow 58 a sufficient distance to allow for one end of the elastic band 54 to be caught in the hook end. Further lifting pulls the captured end of the second elastic band 54 in the direction indicated by 60 up through the end of the third elastic band 56 for assembly on to another adjacent pin 26 as is shown in FIG. 14B. The captured end is pulled up and over the flanged top 38 and pulled back onto the adjacent pin to form a single link. The captured end of the elastic band 54 is then released to engage the adjacent pin 26. This process is repeated until a chain of links a desired length is obtained. The captured end then becomes the "top" elastic band relative to an underlying band.

The example illustrated in FIGS. 14A, 14B and 14C illustrate a chain formed from a single row of links. The example base template 12 can be arranged to support many pin bars 14 and therefore links can be formed longitudinally and laterally across adjacent pin bar 14 to form a wide variety of link configurations and combinations.

Figure 16:
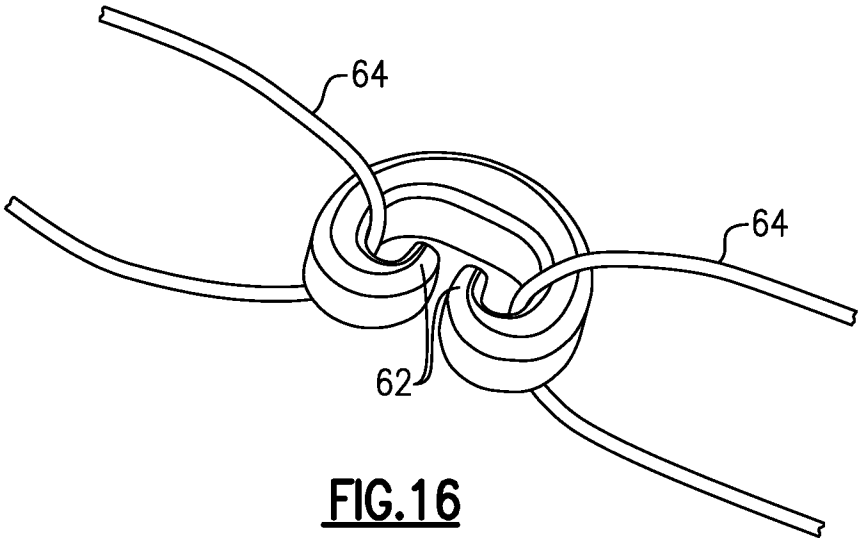
FIG. 16 is perspective view illustrating elastic bands secured with the example clip.
Figure 15:
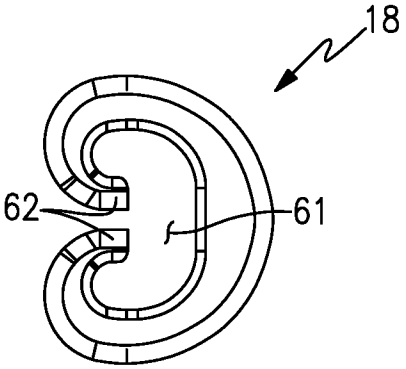
FIG. 15 is a plan view of an example clip for securing loose ends of a Brunnian linked article.
Figure 17:
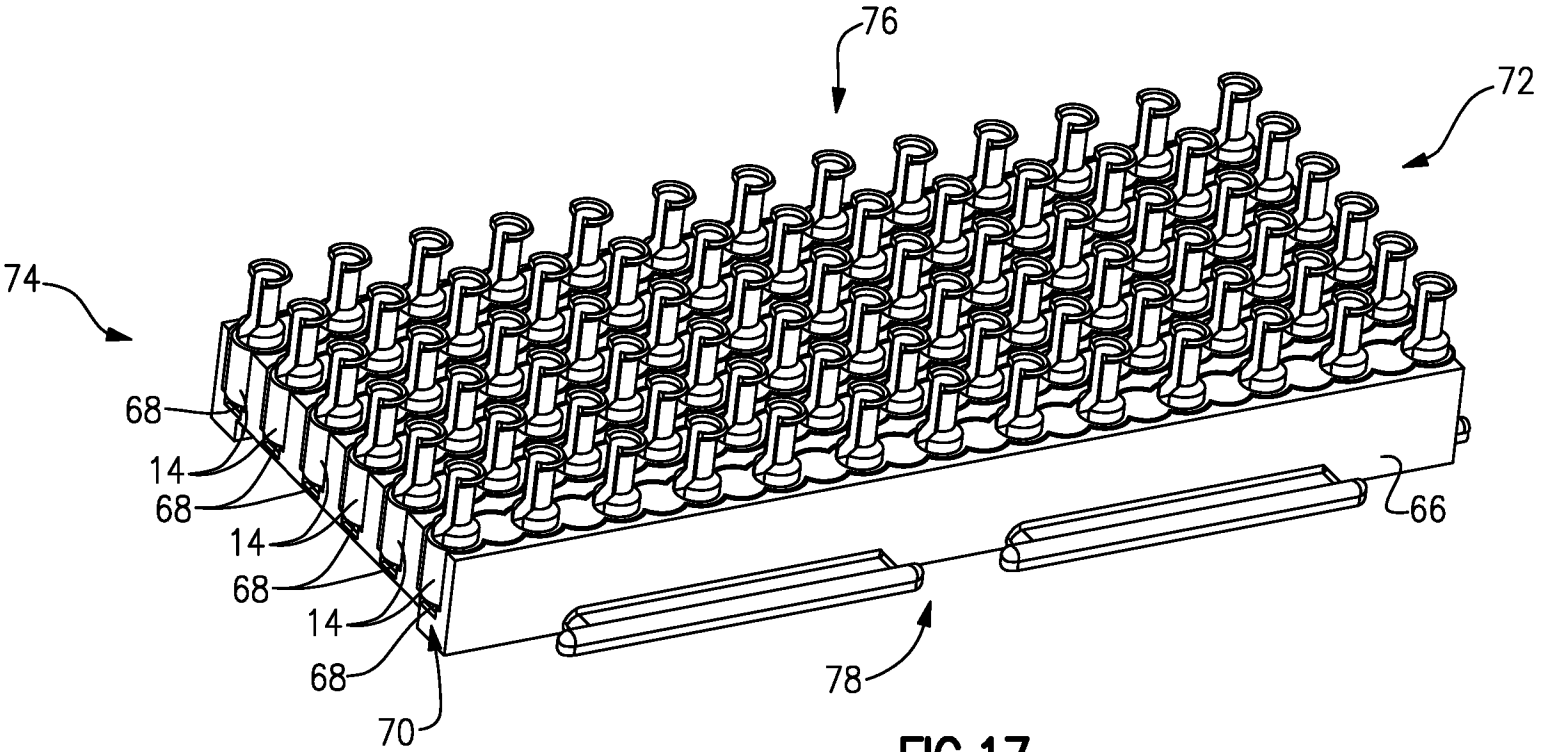
FIG. 17 is a perspective view of an example base template for holding pin bars in a desired special orientation.

Referring to FIGS. 15 and 16, once the link is created, the clip 18 is used to secure the ends such that the fabricated chain of links does not come undone. The clip 18 is substantially C-shaped with an inward facing ends 62 that trap ends of the elastic bands 64 within the inner area 61.

Referring to FIGS. 17-20, an example base template 66 is shown for holding six pin bars 14 in a desired orientation. Each of the example pin bars 14 includes the opening 30 of a defined size and the base template 66 includes a plurality of circular bosses 68 that are sized to provide a desired tight interference fit with the openings 30 in the pin bar 14 such that the pin bar 14 is retained in place within grooves 70 of the base template 66. The interference fit between the pin bar 14 and the bosses of the base template 66 assure a positive mounting and securing of to the base to prevent separation during use and construction of a desired wearable item.

Figure 18:
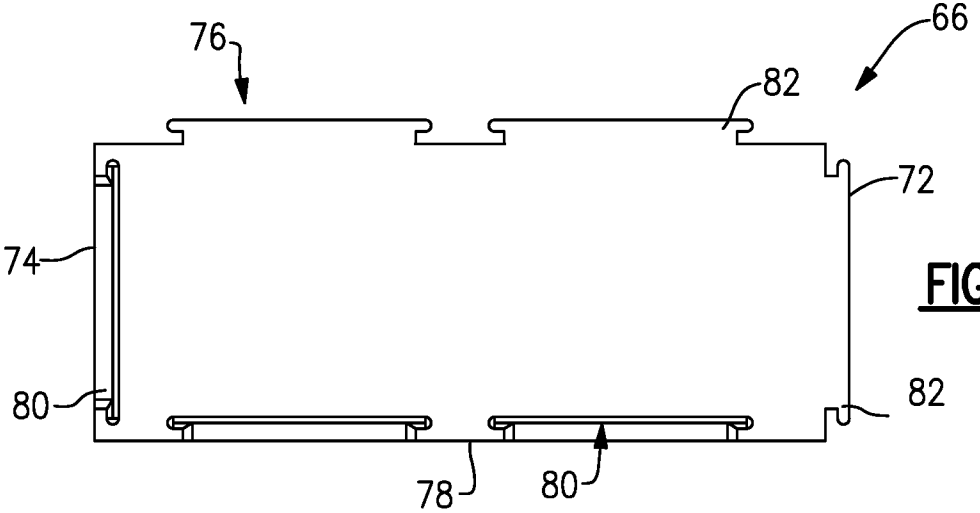
FIG. 18 is a bottom view of the example base template.
Figure 20:
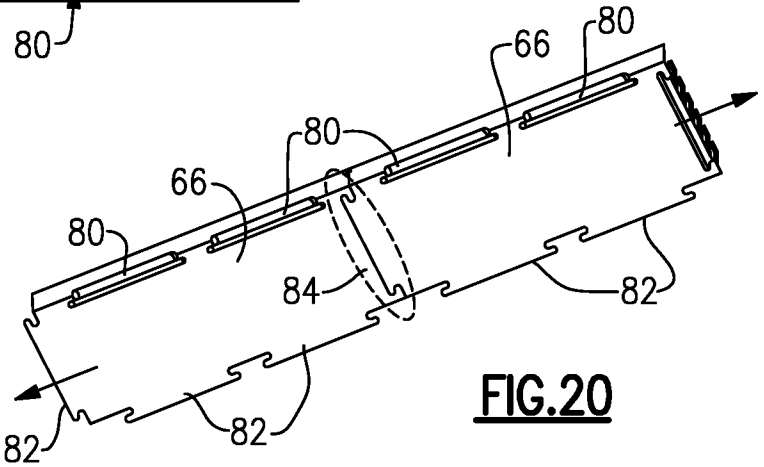
FIG. 20 is a perspective view of an end to end attachment of two base templates.
Figure 19:
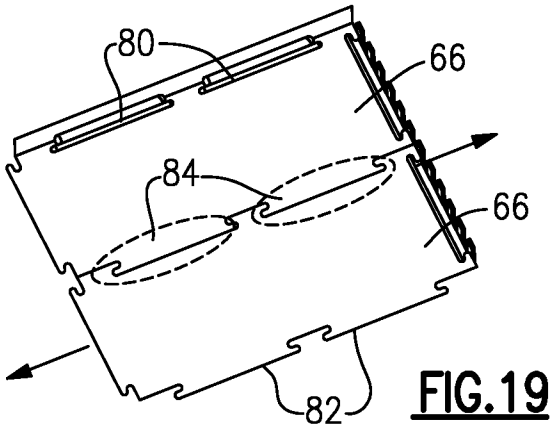
FIG. 19 is a perspective view of side by side attachment of two base templates.

Referring to FIGS. 18, 19 and 20, the base template 66 includes first and second ends 72, 74 and first and second sides 76, 78 between the first and second ends 72, 74. The first end 72 includes a male joint 80 and the second end 74 includes a corresponding female joint 80. The first side 76 includes a male joint 82 and the second side 78 includes a female joint 80. The alternating sides provide for attachment of several base templates 66 to each other to provide extended capability.

FIG. 19 illustrates two base templates 66 connected to each other in a side-to-side configuration by way of joints 84. FIG. 20 illustrates two base templates 66 connected to each other in an end-to-end configuration by way of joint 84. As appreciated, any number of base templates 66 can be secured to each other to form many different desired configurations. The different configurations provide for many options for creating different shapes and configurations of wearable items.

Accordingly, the example kit and method provide for the creation of many different combinations and configurations of Brunnian links for the creation of bracelets, necklaces, and other wearable items. Moreover, the example kit is expandable to further create and expand the capabilities of potential Brunnian link creations. Further, the example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A device for creating an item consisting of a series of elastic bands, the device comprising:

at plurality of pins spaced apart and extending in a common direction, each of the pins include a flanged top for holding an elastic band and an opening on a bottom surface wherein the flanged top comprises an outwardly flared portion for holding an elastic link in place on at least one of the plurality of pins and an access groove extends through the flanged top; and a base template including a plurality of grooves and bosses within the grooves, the bosses sized to provide a fit with the opening in the bottom surface of the corresponding plurality of pins.

2. The device as recited in claim 1, wherein an interface between the opening and the corresponding one of the plurality of bosses is a slight interference fit to hold the pin in the desired orientation.

3. The device as recited in claim 2, wherein each of the plurality of pins includes a mid portion having a width less than the flange.

4. The device as recited in claim 3, wherein each of the plurality of pins further includes a bottom portion flared outward a width greater than the mid portion.

5. The device as recited in claim 4, wherein the plurality of pins are arranged on a pin bar and secured within the grooves of the base template.

6. The device as recited in claim 5, wherein the base template includes a least one male joint and at least one female joint for securing the base template to an additional base template.

7. The device as recited in claim 6, wherein the male joint and the female joint are disposed on opposing sides and opposing ends of the base template.

* * * * *